US005598723A

United States Patent [19]

Ecker et al.

[11] Patent Number: 5,598,723

[45] Date of Patent: Feb. 4, 1997

[54] HINGE ASSEMBLY FOR HANDCUFFS

[76] Inventors: Robert J. Ecker, 128 Carriage Rd., Chicopee, Mass. 01013; Paul W. Koetsch, 43 Treetop Ave., Springfield, Mass. 01118

[21] Appl. No.: 493,717

[22] Filed: Jun. 22, 1995

[51] Int. Cl.[6] ..... E05B 75/00

[52] U.S. Cl. ..... 70/16; 16/223

[58] Field of Search ..... 70/15–18; 16/223

[56] References Cited

U.S. PATENT DOCUMENTS

| | | | |
|---|---|---|---|
| 1,531,451 | 3/1925 | Neal . | |
| 1,851,206 | 3/1932 | Neal . | |
| 1,855,687 | 4/1932 | Neal | 70/16 |
| 1,872,857 | 8/1932 | Wesson et al. . | |
| 2,390,885 | 12/1945 | Kelley . | |
| 2,759,349 | 8/1956 | McKee | 70/16 |
| 4,089,195 | 5/1978 | Lai | 70/16 |
| 4,287,731 | 9/1981 | Kruger | 70/16 |
| 4,300,368 | 11/1981 | Sullivan | 70/16 |
| 4,314,466 | 2/1982 | Harris | 70/16 |
| 4,509,346 | 4/1985 | Szczepanek | 70/16 |
| 4,574,600 | 3/1986 | Moffett | 70/16 |
| 5,138,852 | 8/1992 | Corcoran | 70/16 |
| 5,205,142 | 4/1993 | Kruger et al. | 70/16 |

FOREIGN PATENT DOCUMENTS

| | | | |
|---|---|---|---|
| 763926 | 5/1934 | France | 70/16 |
| 6808902 | 12/1969 | Netherlands | 70/16 |
| 372619 | 5/1932 | United Kingdom | 70/16 |
| 583610 | 12/1946 | United Kingdom | 70/16 |

OTHER PUBLICATIONS

U.S. Department of Justice National Institute of Justice ("NIJ") Standard–0307.01 (May 1982), on Metallic Handcuff Testing.

*Primary Examiner*—Lloyd A. Gall

*Attorney, Agent, or Firm*—Donald S. Holland, Esq.; Holland & Bonzagni, P.C.

[57] ABSTRACT

An improved hinge assembly is disclosed for interconnecting a pair of handcuffs. In the preferred embodiment, the hinge assembly comprises two parallel single-link hinges that are pivotally attached to the cuffs by trunnion pins. Each link has unique oversized slots, through which the pins extend. This permits the cuffs, when side-by-side, to collapse against one another; and it enables the cuffs to move away from each other for compact wearing over a user's belt. In addition, the trunnion pins are captured within the cuff frames. This avoids tampering found with exposed pivot pins in prior multi-link hinges.

8 Claims, 2 Drawing Sheets

HINGE ASSEMBLY FOR HANDCUFFS

BACKGROUND OF THE INVENTION

This invention relates to interconnecting linkage for handcuffs.

Handcuffs, such as those shown in U.S. Pat. No. 2,390,885 to Kelley, typically have a pair of identical ring-like members interconnected by a chain or hinges. Each ring or cuff comprises two arcuate frame parts, known as a jaw and cheek, that are pivotally coupled to one another. A pawl-and-ratchet mechanism permits one-way rotational movement of the jaw as it pivots through the spaced apart arms or plates that form the cheek. Teeth on the pawl's underside ride over complimentary ratchet teeth in the top of the jaw, as the jaw rotates into the cheek, to lock the cuff around a person's wrist. Spring pressure atop the pawl is meant to prevent the jaw from backing off and unlocking the cuff.

Cuffs are supposed to restrict individuals, but present day criminals pose a problem. Many are drug users, and high when arrested. The drugs (e.g., heroin or crack) make them impervious to pain. When cuffed, addicts will often try to twist and break the cuffs' interconnecting linkage. Though rare, instances have occurred where a rush of adrenalin, coupled with a blockage to pain, have enabled a subdued felon to tear apart a pair of cuffs. The resulting surprise does not sit well with police, who rightfully expect cuffs to work.

Strength standards have been set by the National Institute of Justice ("NIJ"), which is part of the U.S. Department of Justice. According to Section 4.7 of NIJ Standard-0307.01 (1982), each pair of closed handcuffs must withstand a hanging weight of 495 pounds for a period of not less than 30 seconds. The cuffs shall not open under that load, shall show no sign of permanent distortion or fracture and shall function in a normal manner following this test.

Previous attempts have been made either to increase the strength of interconnecting linkages or to restrict the prisoner's ability to twist the linkage. For example, U.S. Pat. No. 4,300,368 to Sullivan discloses a pair of parallel, multi-link hinges for cuffs. They are designed to restrict flexion, rotation and adduction of the prisoner's hands and wrists. However, Sullivan's multi-link hinges are still subject to torsional breakage, though at a reduced risk. This especially occurs if the cuffs are applied to a prisoner's wrists in front of him (e.g., during long transport), instead of behind his back.

Sullivan was an improvement over basically a single-link hinge assembly, disclosed in Netherlands Pat. 6,808,902. While the Dutch hinge avoided the play or flexibility of chains, it had a problem. The assembly was too rigid and did not allow for any axial movement between the cuffs, either away or toward one another. Also, the stiff linkage prevented the cuffs from being folded totally upon one another. There was also a slight triangular shape, which made the cuffs cumbersome to pack (for shipping) and difficult to insert in a policemen's carrying pouch.

It is therefore a primary object of the present invention to provide an improved hinge assembly for handcuffs that overcomes the deficiencies of the prior art.

It is another general object to provide an improved hinge assembly that is superior in strength.

It is still another object to provide such an improved hinge assembly, with oversized pin slots, that permit full nesting of the cuffs, so that they can compactly sit flush against one another in a side-by-side arrangement.

It is a further object to provide an improved hinge assembly that is constructed to avoid tampering found in multi-linkage assemblies.

The above and other objects will become more readily apparent when the following descriptions are read in conjunction with the accompanying drawings.

SUMMARY OF THE INVENTION

An improved linkage assembly is disclosed for interconnecting a pair of handcuffs. In the preferred embodiment, the hinge assembly comprises a pair of parallel single links that are connected to the cuffs by trunnion pins. Each link has slots that are oversized lengthwise, oblong in the drawings. These oversized slots allow the cuffs to be slightly pulled apart axially but prevent twisting. They also allow the cuffs to be nestled against one another, flush, for packing or storage. In tensile strength tests, the cuffs exceed NIJ standards.

DETAILED DESCRIPTION OF THE PREFERRED EMBODIMENT

Figure 1:
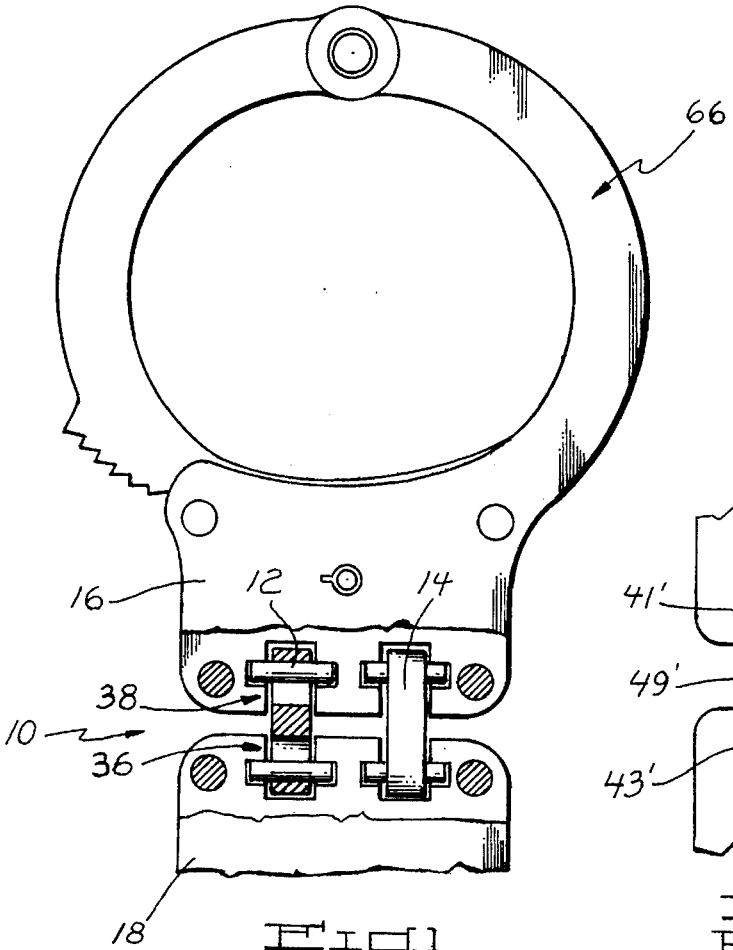
FIG. 1 illustrates an "Improved Hinge Assembly For Handcuffs" constructed in accordance with the present invention, in which a pair of cuffs is extended laterally to the maximum extension.

Referring to the drawings in detail, FIGS. 1 and 3–7 shows Applicants' "Improved Hinge Assembly for Handcuffs". It is generally designated by the reference numeral 10.

There are multiple types of prior hinge assemblies, such as those disclosed in Netherlands Pat. 6,808,902 and U.S. Pat. No. 4,300,368 to Sullivan (described in this application's "Background" section). Both patents are hereby incorporated by reference.

Figure 2:
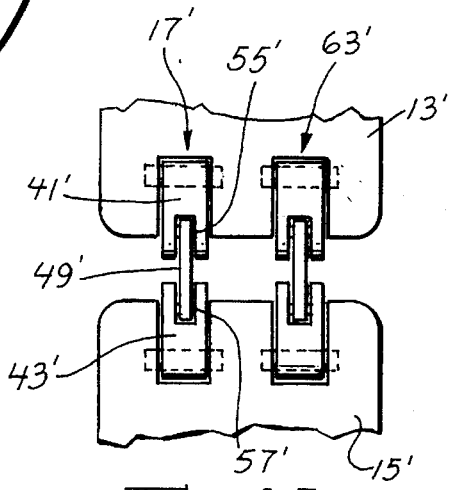
Fig.2. PRIOR ART
FIG. 2 shows a "Prior Art" view of the multi-piece hinge assembly of U.S. Pat. No. 4,300,368 to Sullivan.

FIG. 2 shows the Sullivan device. For ease of reference, it uses the same reference numbers for parts found in Sullivan's patent. However, primes have been included after them to avoid any confusion with Applicants' invention.

Sullivan's multi-piece hinge assembly utilizes a pair of identical parallel hinges 17', 63'. Each hinge has three links: a first main body or anchor link (e.g., 41') pivotally pinned to a first cuff 13'; an identical, second main body (e.g., 43') similarly pinned to a second cuff 15'; and a thinner mid-link (e.g., 49') that interconnects the main bodies. The mid-link is pivotally attached, at opposite ends, to the main bodies by trunnion pins (e.g., 55', 57'). These trunnion pins are exposed to tampering; and the thin mid-link is the portion most subject to torsional breakage.

Figure 3:
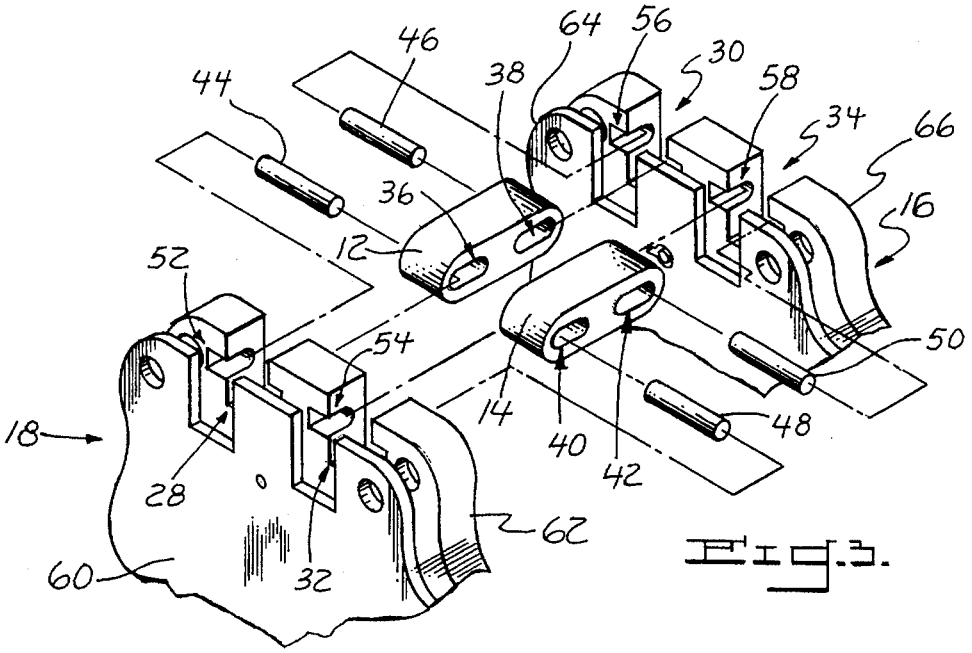
FIG. 3 is an exploded view of Applicants' "Improved Hinge Assembly"
Figure 4:
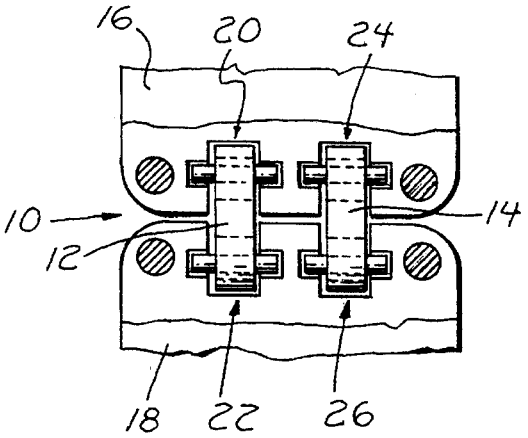
FIG. 4 shows the FIG. 1 cuffs pushed laterally toward one another, using the "Improved Hinge Assembly"

FIG. 3 best shows Applicants' preferred embodiment of their improved hinge assembly 10. It comprises a pair of identical single-piece elongated links 12, 14 that securely interconnect a pair of cuffs 16, 18. Each link 12, 14 is oblong in cross section, with rounded ends 20, 22, 24, 26 (see FIG. 4) to assist in pivoting the ends within respective grooves 28, 30, 32, 34 of the cuffs. Each link 12, 14 also has two uniquely oversized slots or throughbores 36, 38 or 40, 42 (see FIG. 3). They too are oblong in cross section. In the preferred embodiment, the length of each slot 36, 38, 40, 42 is approximately twice the diameter of four identical trunnion pins 44, 46, 48, 50. These pins extend through the slots and rest in corresponding frame pockets (e.g., 52). Cheek plates 60, 62, 64, 66 retain the pins 44, 46, 48, 50 in their pockets 52, 54, 56, 58 to provide a tamper-proof anchoring of the pins into the pockets.

Figure 5:
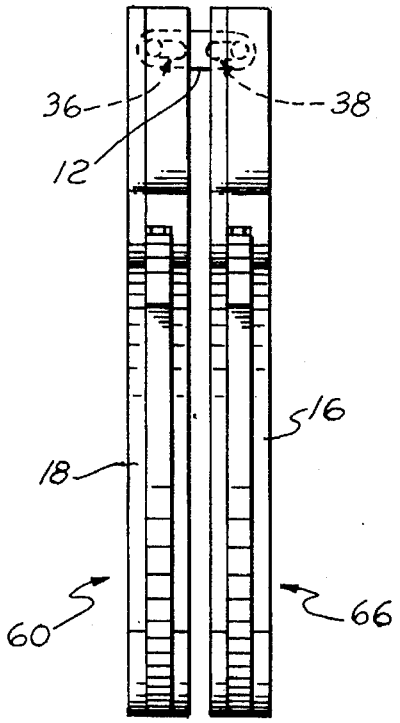
FIG. 5 shows two side-by-side cuffs with the "Improved Hinge Assembly", extended laterally, so as to enable the cuffs to fit over a wearer's belt.
Figure 6:
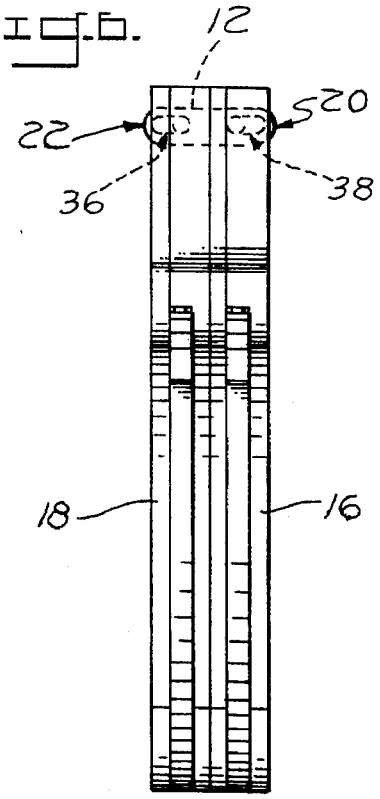
FIG. 6 is a view similar to FIG. 5, but with the cuffs pushed flush together to allow for storage or packing.
Figure 7:
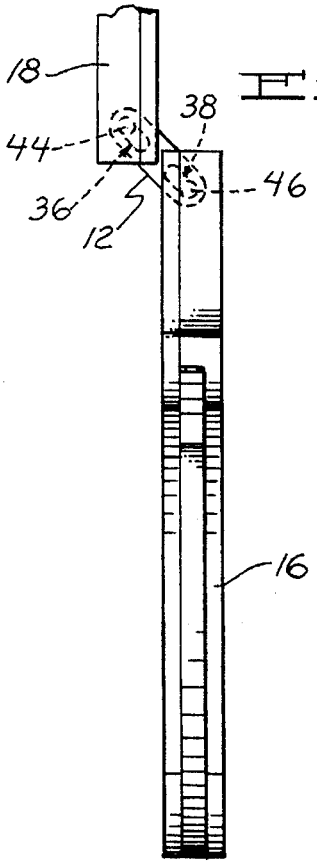
FIG. 7 shows the ability of cuffs to pivot freely axially with the "Improved Hinge Assembly".

Slots 36, 38, 40, 42 allows links 12, 14 to move laterally to the extent that the cuffs 16, 18 may pivot freely on pins 44, 46, 48, 50 and not interfere with each other. This allows the cuffs 16, 18 to be folded together flat, or nestled, as in FIG. 6. The lateral movement allowed by the oversized slots, as shown in FIG. 5, provides for the ability to hang the cuffs comfortably on either side of a work belt (not shown). Yet, the slots are short enough so that any protrusion by them beyond the bodies of the cuffs is insufficient to allow tampering by insertion of a foreign object, like a pin.

In Netherlands Pat. 6808902, the rigid link has standard slots, sized to closely approximate the pins that go through them. This configuration basically prevents any axial movement and side-by-side nesting (see FIG. 3 in that patent). Applicants' hinge assembly, due to its oversized slots, allows both and makes cuffs more compact for shipping or storage.

There are several advantages to Applicants+ single-link hinges over the triple-link hinges found in U.S. Pat. No. 4,300,368 to Sullivan. For example:

1. Because of the reduction in the number of pivot joints, there is substantially less ability to twist and break the assembly. This restrains the prisoner more effectively.

2. The cross-sectional area of Applicants' single link (12 or 14) is larger than that of the small mid-link (e.g., 49') of Sullivan's triple-link hinges 17', 63'. Applicants' design is therefore stronger.

3. The improved single-link design 10 means no pivot pins (like 55', 57' in Sullivan's) are exposed to tampering Applicants' pins 44, 46, 48, 50 are fully captured in the cuff frames.

4. Sullivan's triple-link hinges 17', 63' have exposed U-shaped ends in their main bodies (e.g., 41'), near pivot pins 55', 57'. They can be pried apart Applicants' hinges pose no such problem because they are single, unitary links.

It should be understood by those skilled in the art that obvious structural modifications can be made without departing from the spirit of the invention. For example, Applicants' hinge assembly could work with only one thicker link rather than two links, and it could work, though not as easily, with only one oversized slot. Accordingly, reference should be made primarily to the accompanying claims, rather than the foregoing Specification, to determine the scope of the invention.

Having thus described our invention, what is claimed is:

1. A hinge assembly in a pair of handcuffs, said assembly comprising: at least one elongated link pivotally connected, at opposite end portions, to the handcuffs by trunnion pins, wherein the link has at least one oversized slot means, through which one of the trunnion pins extends, to allow the handcuffs to move axially relative to one another, but prevent twisting of the handcuffs, and to allow the handcuffs, when side-by-side, to collapse flush against one another.

2. The hinge assembly of claim 1 wherein the assembly further comprises a second elongated link pivotally connected, at opposite end portions, to the handcuffs by trunnion pins, wherein the two links are parallel to one another and the second link has at least one oversized slot means, through which one of the trunnion pins extends, to allow the handcuffs to move axially relative to one another but prevent twisting of the handcuffs, and to allow the handcuffs, when side-by-side, to collapse flush against one another.

3. The hinge assembly of claim 2 wherein each link has two identical versions of the oversized slot means in the link's opposite end portions.

4. The hinge assembly of claim 3 wherein the pins are captured within frame pockets of the handcuffs to prevent tampering.

5. A hinge assembly in a pair of handcuffs, said assembly comprising: a pair of parallel elongated links, wherein each link has opposite end portions with oversized slot means, through which respective trunnion pins extend for attachment to the handcuffs, to allow the handcuffs to pivot about the pins, to allow the handcuffs to move toward or away from one another but prevent twisting of the handcuffs, and to allow the handcuffs, when side-by-side, to collapse flush against one another.

6. The hinge assembly of claim 5, wherein the trunnion pins are captured within frame pockets of the handcuffs to shield the pins from tampering.

7. A hinge assembly in a pair of handcuffs, said assembly comprising:

a. a pair of parallel elongated links pivotally attached to the handcuffs by trunnion pins, wherein each of the links has a mid-length with two discrete oversized slots, near opposite end portions of the link;

b. the trunnion pins extend through the slots and are attached to the handcuffs; and c. wherein the length of each slot is substantially greater than a diameter of the pin extending through it to allow the handcuffs to pivot freely about the pins, to allow the handcuffs to move axially relative to one another but prevent twisting of the handcuffs, and to allow the handcuffs, when side-by-side, to collapse flush against one another.

8. The hinge assembly of claim 7, wherein the trunnion pins are captured within frame pockets of the handcuffs to shield the pins from tampering.

* * * * *